US008172171B1

(12) United States Patent
Johnson et al.

(10) Patent No.: US 8,172,171 B1
(45) Date of Patent: May 8, 2012

(54) DOFF SYSTEM AND METHOD

(75) Inventors: David W. Johnson, San Diego, CA (US); Scott G. Moyers, San Diego, CA (US); James M. Hook, Alpine, CA (US)

(73) Assignee: Ebert Composites Corporation, Chula Vista, CA (US)

( * ) Notice: Subject to any disclaimer, the term of this patent is extended or adjusted under 35 U.S.C. 154(b) by 0 days.

(21) Appl. No.: 12/984,857

(22) Filed: Jan. 5, 2011

Related U.S. Application Data

(60) Provisional application No. 61/292,957, filed on Jan. 7, 2010.

(51) Int. Cl.
*B65H 75/24* (2006.01)

(52) U.S. Cl. ..... 242/573.6

(58) Field of Classification Search ..... 242/573.6, 242/573.5, 574.4, 574.3, 574.2, 574.1, 574, 242/571, 572, 573, 573.2, 573.3
See application file for complete search history.

(56) References Cited

U.S. PATENT DOCUMENTS

| | | | | |
|---|---|---|---|---|
| 442,309 | A * | 12/1890 | Diamond et al. | 242/574.3 |
| 2,678,175 | A * | 5/1954 | Wiig | 242/574.1 |
| 4,278,112 | A * | 7/1981 | Takahashi | 139/452 |
| 5,318,236 | A * | 6/1994 | Morello et al. | 242/574.3 |
| 6,345,781 | B1 * | 2/2002 | Bowers | 242/422.4 |
| 6,935,665 | B2 * | 8/2005 | Jones et al. | 294/97 |

* cited by examiner

*Primary Examiner* — William E Dondero
(74) *Attorney, Agent, or Firm* — Stephen C. Beuerle; Procopio Cory Hargreaves & Savitch LLP

(57) ABSTRACT

An adjustable doff core device for installation in the hollow center of a center-pull doff has a tubular core with a fixed internal diameter configured for engagement on a processor configured to dispense material from the outside of a doff. An adjustable outer press bar portion is adjustably mounted on the outside of the tubular core by an adjustment mechanism and is movable between an inner, contracted position and outwardly expanded positions spaced outwardly from the tubular core to define an adjustable outer diameter of the device. The press bar portion is configured for substantially non-slip engagement with an inner diameter of a hollow center-pull doff. A locking device releasably locks the press bar portion in a selected adjusted position.

18 Claims, 4 Drawing Sheets

DOFF SYSTEM AND METHOD

RELATED APPLICATION

The present application claims the benefit of U.S. provisional pat. App. Ser. No. 61/292,957, filed Jan. 7, 2010, the contents of which are incorporated herein by reference in their entirety.

FIELD OF THE INVENTION

The present invention relates to a doff system and method for enabling dispensing of tows of material such as fibers from a center-pull doff.

BACKGROUND OF THE INVENTION

In the composites reinforcement industry, and in particular, the fiber side of the industry, where common fibers are glass, carbon, aramid (Kevlar) and the like, there is a need to transition these fibers from their "as-built" state to process dispensing in the most efficient manner. The term "efficient" in this disclosure means both dispensing with the minimum disturbance and in an "untwist fashion".

In the fiberglass industry in the US, dominated by Owens Corning, PPG, Vetrotex, and FGI, there is a process in which a "doff" of fiberglass is automatically made in a 24 hour-per-day operation. Molten glass in an elevated furnace is allowed to drop naturally through Platinum bushings and is cooled and consolidated into thousands of glass filaments that make up a single "tow". This tow may have sizing added, but the tow can be traveling at 100 miles per hour as it exits the Platinum bushings.

This tow is in a flattened "wet" state (from sizing solutions) that allow it to be formed into a band as it is automatically wound up onto a temporary mandrel of paper or cardboard sleeve material in a very precise wound pattern. This wound pattern quickly increases from approximately 4-6 inches in inside diameter to approximately 10-11 inches in outside diameter in perhaps 2-3 minutes. A glass doff, when completed may weigh approximately 40 lbs. and have 3 miles of glass tow wound around the temporary cardboard or paper sleeve or inside mandrel.

When a doff is completed in the automatic winding process, a laborer will manually remove the finished 40-lb doff and stack it on a pallet. Once a pallet of wet doffs is completed they will be sent to a large drying operational room, and left to dry the wet sizing for many hours. After a set time the "dry" doffs are removed from the room and they are taken to a final prep-to-ship area. Here a laborer will remove the temporary sleeve from the inside of the doff and may actually discharge manually a layer (or two) of fiberglass that is not fully dry. Shrink wrap will be put on the outside of the doff for handling and shipping and the doff will be stacked onto a pallet for shipping. Doffs produced in this way are known as center-pull doffs, since they require dispensing of tows from the inside to the outside of the doff.

This doff is then sold to a processor such as a pultrusion manufacturer, weaving or stitching manufacturer, or any of about 30 different types of "composite processors" where it is combined with resins and a composite will be formed (this obviously an over-simplified explanation of "processing"). All of these processors remove the fiberglass doff from the shipping pallet and stack the doff onto a shelf, rack, or horizontal surface, and then the manufacturer dispenses a single tow from one doff, along with hundreds, or even thousands of tows from like doffs, and processes all tows in parallel into a composite of some shape and design.

This action is referred to as "Center-Pull", since the doff by its very nature requires and demands dispensing from the inside outward. The tow is pulled from the inside of the doff and naturally unwinds in a twisted fashion as it pulls out from the inside diameter (ID) of the doff. Much as a coiled hose, being pulled longitudinally from a coiled state, these generally flat bands of fiberglass tows perform the same physical twisting. With every rotation around the inside diameter of the doff, there is exactly one twist that is imparted to the fiberglass band. This natural twist can have detrimental performance attributes when formed in a composite. The location of the twist can provide a localized void as the filaments cannot stretch. Thus the tow bands have edge filaments that must naturally buckle the interior filaments at the location of a twist. This reduces fiber volume and minimized the quantity of filaments that can be consolidated in a given cross sectional area.

Processors of fiber doffs, including fiberglass doffs, have recognized for some time the need for providing untwisted fiber. They therefore have demanded that the fiber manufacturers rewind a manufactured "virgin" center-pull doff. The doff described above is "virgin" because it exists undisturbed following the initial winding from the furnace bushing and the subsequent drying. Filaments as small as 8-13 microns made from these materials can be very prone to fracture when handled or disturbed. In spite of this problem, processors have asked glass manufacturers to rewind these virgin doffs so that the tows can be dispensed in a less twisted or untwisted state.

This rewind process is interesting. This is because the glass manufacturer takes a virgin doff and installs said doff onto an expensive and sophisticated machine, wherein the inside of the doff is mounted onto the machine and then the doff (with Shrink-wrap removed) is spooled and rotated and the tow is rewound onto a spool from outside-to-inside, creating what is known in the industry as a tangent spool. This tangent spool can be used by a processor such as a filament winder to dispense from the outside of the tangent spool in an untwisted tow fashion, to get the desired results in performance from a composite, with zero twist in the tow.

These tangent spools are typically about ½ the weight of a center-pull doff. But the manufacturer will charge anywhere from 5-10 cents per lb. or more to do this rewinding. The processor also knows that after the doff has been rewound into this tangent spool, that this action is one more step in handling the fiber and that it is likely there will be broken filaments and, thus, degraded strength in the sum of all the filaments that make up the tow.

Machines adapted for handling tangent spools include filament winders and tangent pull dispensing tooling. In order to allow a doff to be placed onto such devices, the fiber manufacturer has to rewind the doff onto a tangent-pull cardboard sleeve of the correct diameter accepted by such machines. As stated, it is well-known in the industry that this rewinding of glass fibers creates some loss in performance, as this secondary handling will undoubtedly break fiber-filaments and affect the structural strength of the end product. Additionally, the rewinding requires labor and time, and it is not unusual for a fiber manufacturer to add 5-10 cents per lb. or more, to the price of a rewound spool of glass fiber, over the price of a "virgin" center-pull doff.

In Applicants prior U.S. Pat. No. 7,690,179 (U.S. application Ser. No. 11/771,919 which claims priority from Prov. App. No. 60/945,853), the contents of which are incorporated herein by reference, an untwist device was disclosed using a novel rotating table, activated by a control system, to dispense tows in an untwisted fashion from an original, center-pull doff. This device has been commercialized. However, there are some restrictions and difficulties in locating turntables in manufacturing-process plants.

SUMMARY OF THE INVENTION

Embodiments described herein involve a doff system and method in which a virgin, non-rewound center-pull doff of fiberglass or other fiber, is secured to a device which allows the "virgin" glass tows to be dispensed from the outside of the doff in a zero-twist state, exiting the doff in the most undisturbed fashion since the tows were manufactured at the glass furnace bushing discharge. The described embodiments take the variable inside diameter of a center-pull doff and create a means to rotate the doff around its theoretical centerline, simulating a tangent-spool fiber package.

According to one embodiment, a doff core device is provided which simulates the cardboard sleeve of a tangent-pull doff by having a standard or constant internal diameter, but has a variable outer diameter to allow the core device to be secured in the hollow center of center-pull doffs of varying internal diameter. The resultant doff and core assembly or system can be placed onto a filament winder, tangent pull dispensing tooling, or other processors designed to receive the cardboard sleeve of a tangent spool, in place of such a tangent spool.

In one embodiment, the doff core device has a central tubular core of predetermined fixed internal diameter and an outer press bar portion of varying diameter secured to the outside of the core by an adjustment mechanism to allow movement from a compressed, minimum diameter state into expanded states of varying diameter, and can be locked in a selected expanded state. The predetermined internal diameter of the tubular core is selected to allow installation on a filament winder or similar processor designed to dispense fiber from the outside to the inside, in place of a cardboard core onto which a virgin doff of fiber has been rewound after manufacture. The press bar portion in one embodiment comprises a series of spaced longitudinal press bars adjustably mounted on outside of the tubular core via pivoted connecting links pivoted to the respective press bars at one end and to an adjuster nut which is threadably engaged with the tubular core at the opposite end, the adjuster nut and connecting links together comprising the adjustment mechanism. Each press bar extends along the length of the core and has an outer surface configured to press against the inner diameter of a virgin fiberglass doff, i.e. a doff which has not been re-wound subsequent to manufacture. The adjustment mechanism between the tubular core and press bars allows the separation between the core and press bars to be adjusted until the press bars bear against the inner diameter of a virgin doff, and a locking device secures the press bars in the adjusted position.

According to another aspect, a doff method of unwinding fiber tows from the outside of a virgin or center-pull doff without first re-winding onto a cardboard sleeve comprises installing a doff core device of variable outer diameter and constant internal diameter into the cavity or hollow center of a center-pull doff, expanding the doff core device to press against the internal diameter of the doff, and locking the device in the expanded condition. The constant internal diameter of the doff core device is selected to allow installation on processors such as filament winders, tangent pull dispensing tooling, and composite processors designed to accept a cardboard sleeve of a tangent spool, and simulates such a cardboard sleeve onto which fiber tows have been re-wound, thus eliminating the need to re-wind the originally manufactured doff.

Up to now, no such device has existed which can take the variable inside diameter (ID) of a center-pull doff and create a means for rotating said doff around its theoretical centerline, creating a core that simulates a tangent-spool fiber package. The ID of a center-pull doff is variable and can have several tenths of an inch difference in dimensions between a series of shipped center-pull doffs, and the doff core device therefore has an outer diameter which can be varied to fit center-pull doffs over the normal range of IDs encountered in such doffs. The outer press bar portion is configured to have a positive lock on the ID of the center-pull doff. This provides a relatively simple device that can accomplish similar performance outcomes as in the above referenced U.S. Pat. No. 7,690,179 (hereinafter '179 patent).

The doff system and method described herein allows dispensing of virgin fiberglass tows from the outside to the inside of a virgin fiberglass doff, using a device which simulates a tangent spool of a re-wound fiber package. When secured to the doff core device at its center, a center-pull doff can now have a 3 inch or other standard diameter core adapted to the doff's internal diameter, and it is no longer required that the fiber manufacturer has to rewind the doff onto a tangent-pull cardboard sleeve of the correct diameter accepted by such machines.

DETAILED DESCRIPTION OF THE INVENTION

Certain embodiments as disclosed herein provide for a system and method for unwinding a virgin center-pull fiber doff from the outside to the inside, to avoid the need to re-wind the doff before dispensing material or tow from the doff.

Reference will be made herein to glass filament manufacturing, such as plants that produce multiple glass filaments, also known as fiberglass. However, the advantages disclosed herein may apply to any fiber reinforcement, not only fiberglass, and may also apply to doffs of fiber such a carbon, aramid, co-mingled thermoplastic roving (such as Twintex), thermoplastic fibers, PE fibers, basalt fibers, and the like. Even though the following description refers to a fiberglass process, it should be understood that the doff core device and method described herein applies equally to processing of other fiber materials. The doff core device and method described below may also be used to handle any elongate material that is coiled and needs a temporary core, not only fiber material, and is therefore applicable to other industries and materials which require spooled packaging.

After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention.

Figure 1:
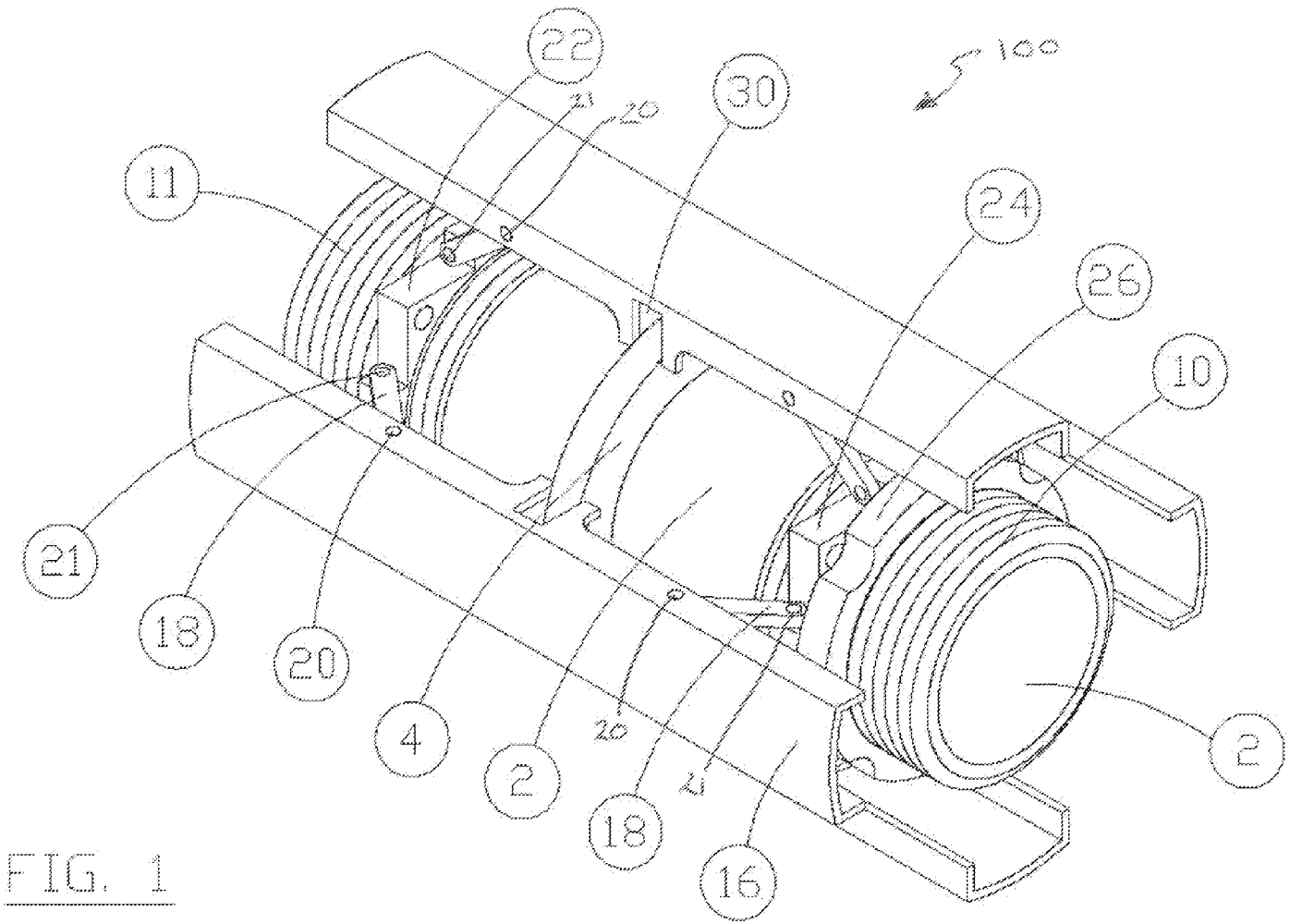
FIG. 1 is a perspective view of an embodiment of a doff core device in a somewhat "expanded" state.
Figure 2:
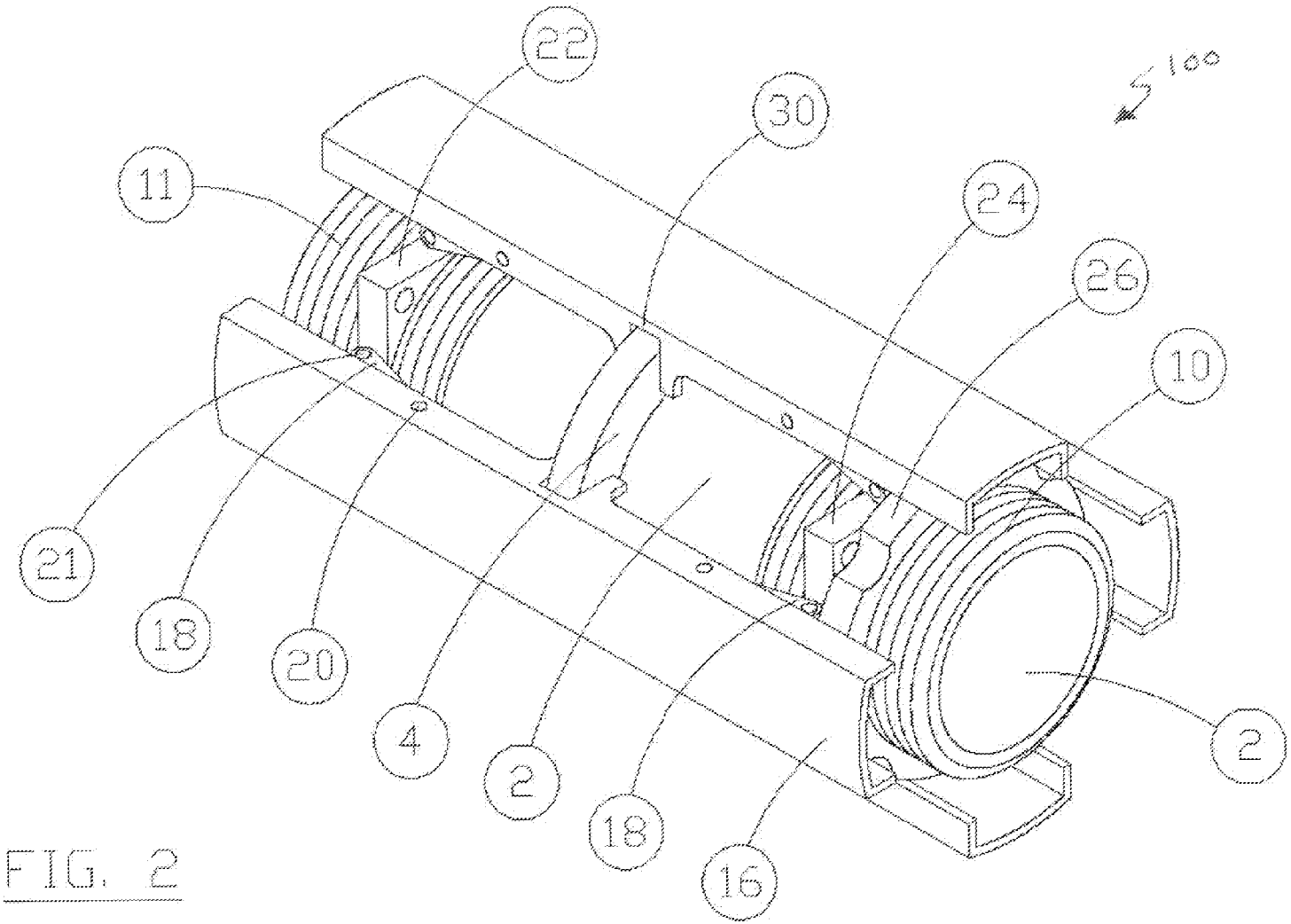
FIG. 2 is a perspective view of an embodiment of a doff core device in a "compressed" state.

FIGS. 1 and 2 illustrate one embodiment of a doff core device 100 configured for insertion into the hollow center of a coil or "doff" of elongate material or fiber, such as the center of a virgin fiberglass center-pull doff, to enable dispensing from the outside to the inside of the doff. FIGS. 3 to 6 illustrate various components of the device, as described in more detail below. The doff core device 100 has a constant internal diameter selected to fit on a predetermined processing machine such as a filament winder or dispenser or tangent pull dispensing tooling, as well as a variable outer diameter. FIG. 2 illustrates the device in a compressed state, i.e. the minimum outer diameter state in which it can be easily inserted into the hollow center of a center-pull doff. FIG. 1 shows the same core device in a somewhat "expanded" state, as it might be when fully engaged to the inside of a center-pull doff.

Figure 4:
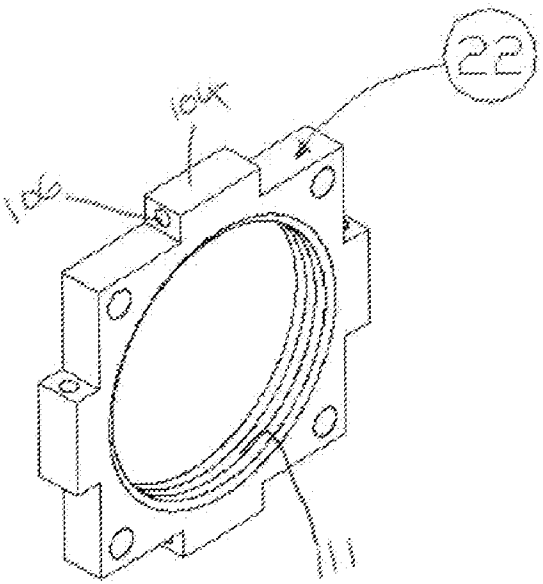
FIG. 4 is a perspective view of an embodiment of a left hand, internally threaded expander nut of FIGS. 1 and 2.
Figure 5:
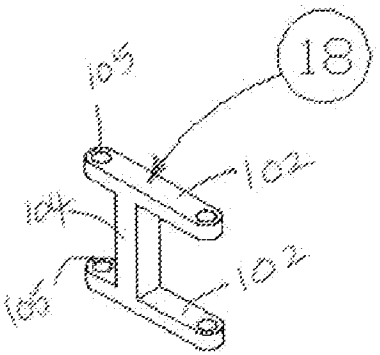
FIG. 5 is a perspective view of an embodiment of an H-arm of the device of FIGS. 1 and 2.

Many, if not all of the parts of the doff core device can be made from injected molded plastic, although any suitable material could used to fabricate the shapes, by any suitable process known to those skilled in component manufacturing. As illustrated in FIGS. 1 and 2, the device basically comprises a tubular core 2, which is cylindrical and hollow, having a core inside diameter of any desired size, but which typically might be 3.0 inches, and a press bar portion or adjustable diameter portion adjustably secured to the tubular core by an adjustment mechanism. In the illustrated embodiment, the press bar portion comprises a plurality of circumferentially spaced press bars 16 adjustably secured to the outside of tubular core 2 and configured to move radially inwards and outwards to vary the outer diameter of the device. The adjustment mechanism comprises a pair of internally threaded expander nuts 24, 22 illustrated in more detail in FIGS. 3 and 4, and a plurality of H-arms or pivotal connecting links 18, one of which is illustrated in FIG. 5, which secure the nuts 24, 22 at an adjustable spacing from the respective press bars 16.

There are four press bars 16 in the assembled device of FIGS. 1 and 2 and a respective H-arm or pivotal connecting link 18 is pivoted at one end to one of the press bars via pivot pin 20, and at the opposite end to a respective expander nut 24, 22 via pivot pin 21, so that there are four H-arms or connecting links 18 between each nut and the respective press bars, i.e. a total of eight H-arms. As the press bars move outwardly, the H-arms also pivot outwards, as can be seen by a comparison between the compressed or inwardly folded position of the H-arms in FIG. 2 and the expanded position of the arms in FIG. 1. A lock nut 26 (FIG. 7) secures the device at a selected outer diameter, as described in more detail below.

The length of doff core device 100 of FIGS. 1 and 2 might be typically 10-11 inches, although clearly any length is possible. The length of each press-arm is substantially equal to the length of the hollow tubular core 2. The hollow tubular core has an annular, outwardly projecting shoulder 4 centrally located on the core. Shoulder 4 is a right circular cylinder section and is either made integrally with tubular core 2 or is added to the tubular core 2. A second feature of tubular core 2 is the external threads 10, 11 on opposite end portions of the tubular core. The main difference between threads 10 and 11 is one is a left-hand thread and the other is a right hand thread, said difference requires no explanation here as the difference is well-known and requires no explanation. The fact that both 10 and 11 are oppositely threaded means that it does not matter which one is identified as the right hand-threaded end, but for this discussion, the threaded end 10 is a right hand thread and threaded end 11 is a left hand thread.

Figure 3:
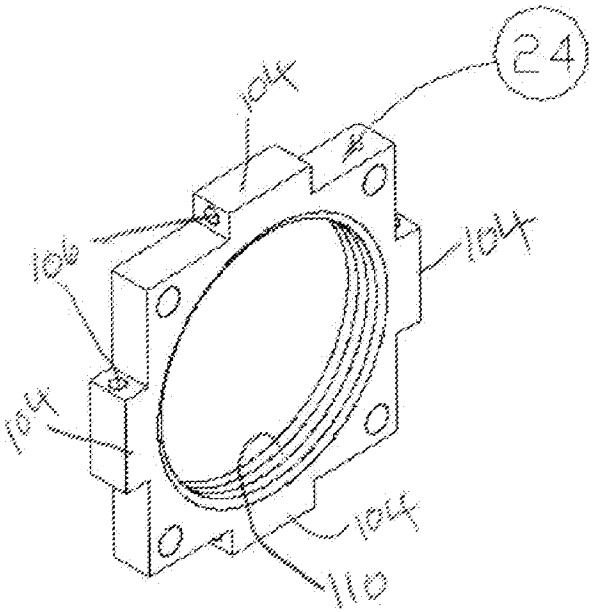
FIG. 3 is a perspective view of an embodiment of a right hand, internally threaded expander nut which forms part of the device of FIGS. 1 and 2.

Expander nut 24 has right hand, internal threads 110 configured for threaded engagement over the right hand threads 10 of the tubular core 2, while expander nut 22 has left hand, internal threads 111 configured for threaded engagement over the left hand threads 11 at the opposite end of the tubular core. As illustrated in FIGS. 3 and 4, expander nuts 24 and 22 are identical, except for their respective internal threads which are opposite, and like reference numbers have been used for like parts. In an alternative configuration, the threads on opposite ends of the tubular core and the nuts may be reversed. The outer diameter of each nut 24, 22 is generally square, with an outwardly projecting, generally rectangular pivot mount or connector portion 104 on each of the four outer sides of the square shaped outer surface of the nut. A through bore or opening 106 extends through each pivot connector portion 104.

As noted above, there are eight H-arms or pivoted connecting links 18 in device 100. One H-arm or connecting link is shown in FIG. 5, and is of H-shape with two parallel portions 102 connected by cross bar 103. During assembly of device 100, one end of each link or H-arm is placed over a respective pivot connector portion 104 of nut 24 or 22, and secured to the respective nut via a pivot pin 21 extending through opening 105 at the end of one of the portions 102, through the bore 106 in pivot connector portion 104, and through the aligned opening 105 in corresponding end of the other portion 102 of the H-arm 18. Once the respective nuts are installed on the threaded end portions of tubular core 2, the opposite ends of each H-arm are in turn pivotally connected to the four press bars 16 via pivot pins 20. In each of the eight locations incorporating free-spinning or pivot pins 20 or 21 (i.e. at opposite ends of each of the eight H-arms), the H-arm is allowed to spin, or rotate, freely about the central axis of the pins 21 and 20.

Figure 6:
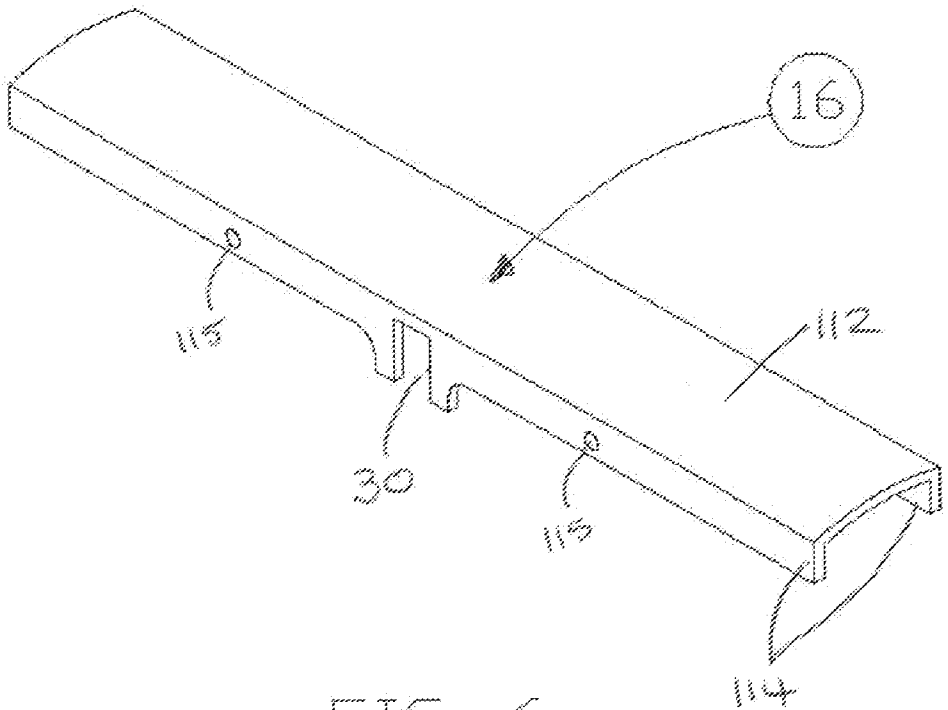
FIG. 6 is a perspective view of an embodiment of a press bar of the device of FIGS. 1 and 2.

One of the press bars 16 is illustrated in more detail in FIG. 6. These components are referred to herein as press bars because they are the vehicle that transmits angular momentum, and torque, through the tubular core 2, to the center-pull doff. In one embodiment, each press bar 16 is an elongate bar of generally U-shaped cross-section with a central portion 112 and down-turned rims 114 facing tubular core 2. The central portion in the illustrated embodiment is slightly curved or arcuate and may have a curvature corresponding to the estimated internal diameter of a center-pull doff, although other shapes may be used in alternative embodiments for pressing against the inner surface of the center-pull doff. This curvature should be apparent when examining FIGS. 1, 2, and 6 and looking at the ends of the press bars, 16. This curved surface may additionally have a "high-friction" outer surface to prevent or resist slipping between the core and the center-pull doff. A slot 30 is arranged centrally in the inside surface of each press bar 16 for engagement over annular shoulder 4 of tubular core 2, as illustrated in FIGS. 1 and 2. The engagement between shoulder 4 and press bar slots 30 provides a guide for radial inward and outward movement of each of the press bars. Aligned openings 115 are provided in the opposite rims 114 on opposite sides of slot 30 for receiving pivot pins 20 which pivotally secure the ends of respective H-bars 118 to the press-arm 18, and which in turn are secured to the respective nuts 24 and 22.

Figure 7:
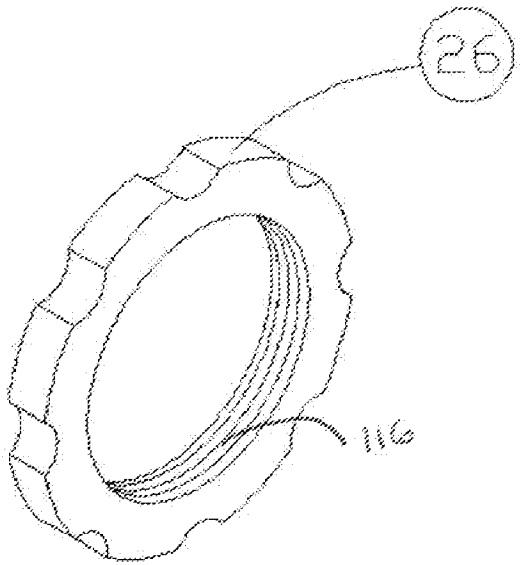
FIG. 7 is a perspective view of an embodiment of a lock nut of the device of FIGS. 1 and 2.

The final part of device 100 is the lock nut 26 which is shown in FIG. 7. In the configuration shown, the lock nut 26 has a right hand internal screw thread 116 and is used to "jam" or lock the expander nut 24 in a secure manner at a selected position on threaded end 11 of the tubular core 2, as illustrated in FIG. 1. Lock nut 26 could also have a left hand thread if located on the opposite side of tubular core 2, and could then be used to lock expander nut 22.

One embodiment of a method of securing the doff core device 100 of FIGS. 1 to 7 in the center of a center-pull doff is described in more detail below.

In FIG. 2, the press bars 16 are in a retracted position with H-arms pivoted inwards and close to the outer surface of tubular core 2. At the start of the installation, the lock nut 26 is not on tubular core 2, or is significantly threaded backwards toward the end of tubular core 2 so that adjuster nut 24 is free to move. The device in this position or configuration has a first or minimum outer diameter and can be inserted manually into the center of a center-pull doff.

Once the device is inserted, the user holds one of the press bars 16 with one hand (any one of the four press bars may be held during this step) while rotating tubular core 2 relative to the press bars, such that the expander nut 24 incrementally moves along threads 11 toward the central shoulder 14. In one embodiment, the end of tubular core 2 may be slotted to accept a simple torque wrench, so as to assist the installer in rotating the tubular core relative to the press bars and attached expander nuts.

Several things happen during this step. Not only does expander nut 24 move toward the central shoulder 4, but expander nut 22 also moves inward towards the shoulder 4 due to the rotation of tubular core 2, at the same speed and rate of displacement. At the same time, the H-arms 18 synchronously rotate about their respective pivot connections to the nuts and the press bars, moving the four press bars 16 outboard to expand the device to a larger outer diameter (see FIG. 1). Due to the central slots 30 in the press bars which engage the shoulder 4 on tubular core 2, the four press bars move out in parallel, causing all eight of the H-arms to always be at identical angles to the centerline of tubular core 2.

The above movements are all caused by only the manual right hand threading of expander nut 26, by way of rotation of the tubular core, 2. Due to the connections, the left hand threading of expander nut 22 occurs automatically, with no manual torque of the nut 22 required. In other words, the single person installing this expander does not have to physically touch the expander nut 22. By holding a press bar 16 with one hand and rotating the tubular core, all key components of the enabler move linearly. That is, the expander nuts move linearly toward the shoulder 4 of the tubular core and the press bars move linearly outward to contact the center of the center-pull doff.

The installer continues to move the right hand expander nut, by rotating the tubular core 2 with manual torque until the press bars are tight and secure to the inside diameter of the center-pull doff. Now the lock nut 26 is threaded onto the threads 11 at the right hand end of tubular core 2, until it jams with the expander nut 24. Device 100 is now locked in its expanded condition inside the center-pull doff.

The process is complete. The internal core of the tubular core can now be installed on any filament winder equipment, tangent pull dispensing equipment, or composite process equipment, and each of these alternatives is hereinafter referred to as doff processing equipment. Outside tangent fiber can then be dispensed from the thus enabled center pull doff. Once all outside tangent fiber has been dispensed from the outside of the center-pull-doff, the above process can be reversed by first removing the lock nut 26, then holding one of the press bars while rotating tubular core 2 in the opposite direction so that the press bars are retracted inwards as the expander nuts move away from shoulder 4. The device 100 is now ready to be installed in a new center pull doff. Theoretically, the device 100 can be used over and over and the applicants foresee no event that would cause sufficient "wear" or to require an overhaul. Certainly damage may occur due to mishandling or abuse, but there is no reason that the doff core device 100 cannot be a productive component for a manufacturer for many years of operation. The doff core device and installation method described above allow a virgin center pull doff to be installed directly on outside-to-inside unwinding machinery or processing equipment by one person. The doff core device is light weight and inexpensive to manufacture and use, and can be easily handled with no special tools.

Doff core device 100 is easily inserted into the cavity of the center-pull doff and secured in the cavity with a very rapid manual operation by one person. After device 100 is securely installed in a center-pull doff, it can be used as a mounting core to mount the center-pull doff on composite machinery and tooling, allowing a manufacturer to pull the fiber from the outside of a virgin center-pull doff, thus converting the center-pull doff to an "outside-tangent-pull-doff". This avoids having to re-wind virgin center-pull doffs onto cardboard cores before they can be mounted on such machinery, significantly reducing processing time and expense.

Center-pull doffs can have a range of internal diameters which slightly vary from one another. The doff core device 100 described above has a variable outer diameter and can be adjusted mechanically to be secured in center-pull doffs of varying internal diameters, simply by adjusting the positions of nuts 22, 24 along the threads 10, 11, respectively. Thus, the angular momentum and torque can be transferred from the core 2 to the outside of the now "outside-tangent-pull-doff", without any slippage, and be balanced. The centerline of the tubular core 2 is concentric with the theoretical center-line of the center-pull doff.

During installation of device 100 in a center-pull doff, press bars 16 press outboard uniformly from the tubular core, 2, with all press bars moving outwardly at the same distance from the tubular core, such that the press bars all contact the inside of the center-pull doff at the same time. The press bars extend parallel to one another along the length of tubular core 2 and are designed to contact with the inside diameter of the center-pull doff along substantially the entire length of the doff.

Once the press bars are moved outward to securely press against the inside of the center-pull doff, lock nut 26 can be securely placed on the tubular core to lock the press bars in position and to resist or prevent the press bars from releasing the internal friction against the inside of the center-pull doff, regardless of the stage of "pay-out" of the fibrous material, either at the beginning of the doff's use (100% fiber availability) to halfway wherein 50% of the fiber on the doff has been pulled tangentially from the outside of the doff, to where the entire doff is nearly expended, wherein 99% or more of the doff has been thoroughly expended and tangentially dispensed. The core device is therefore unlikely to slip relative to center-pull doff when reasonable processing torques are applied to the outside surface of the doff during processing or dispensing of 100% of the doff fiber.

This efficiency gain allows for a superior composite laminate due to undisturbed fibers having their maximum strength and being dispensed in an at least substantially untwisted state, allowing for the greatest fiber volumes and thus the highest strength per unit cross sectional area, with minimum voids.

The doff core device described above is not limited to use in processing fibers, but may be scaled to handle any elongate material that is coiled and needs a temporary core. The device can be made in various sizes, from very large to very small, with each size covering a different range of outer diameters, depending on the application. Several industries and several materials require spooled packaging and there is practically no limit to the possibilities of adapting a simple version of the doff core device and doff method described above for other materials and industries.

The doff core device described above is a low cost device which allows a processor to take a "virgin fiberglass doff", for example, and dispense that doff in an untwisted fashion from the outside to the inside. This potentially has great benefit to composite processors. They could purchase the lowest cost fiber, i.e. the original center-pull doff (no tangent spools with premium pricing for the rewind effort by the manufacturer), the most "virgin" and undisturbed fiber, convert the center-pull doff to a tangent pull doff by securing the doff core device in the center of the doff, and use the resultant tangent pool doff in the composite process, thus making the composite process less expensive.

The relative dimensions of each of the described components of the doff core device in the embodiment described above, as well as their numbers can be modified in alternative embodiments based on the type of spoolable material and doff dimensions. For example, the device may have more than four or less than four press bars, and the number of pivotal connecting links 18 may be different in other embodiments. The connecting links 18 and expander nuts 22, 23 in other embodiments may also be of different shapes.

The drawings may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in the following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

The invention claimed is:

1. An adjustable doff core device for installation in the hollow center of a center-pull doff, comprising:

a tubular core having a central longitudinal axis and a predetermined standard internal diameter;

an adjustable outer press bar portion spaced outwardly from the tubular core and movable between an inward, contracted position and outer, expanded positions to define an adjustable outer diameter of the device, the outer press bar portion configured for substantially non-slip engagement with an inner diameter of a hollow center-pull doff;

an adjustment mechanism between the tubular core and press bar portion configured to control expansion and contraction of the press bar portion in order to adjust the outer diameter of the device; and a locking device configured to releasably lock the press bar portion in a selected adjusted position, wherein the tubular core has an outwardly projecting annular shoulder located between opposite ends of the core, and the outer press bar portion comprises a plurality of elongate press bars extending parallel to the central longitudinal axis of the core and adjustably mounted on the tubular core for movement in radially inward and outward directions relative to the core, each press bar having a U-shaped cross section extending its entire longitudinal length and an inwardly facing slot, the outwardly projecting annular shoulder having a longitudinal length and the inwardly facing slot having a longitudinal length substantially the same as the longitudinal length of the annular shoulder so that the inwardly facing slot engages over the annular shoulder to guide the inward and outward movement of the respective press bar, whereby said press bars are at least substantially in parallel throughout the inward and outward movement.

2. The device of claim 1, wherein the outer press bar portion comprises a plurality of elongate press bars extending parallel to the central longitudinal axis of the core and spaced around the outside of the tubular core, the press bars being adjustably mounted on the outside of the tubular core and configured for movement parallel to each other in radially inward and outward directions relative to the core, the press bars together defining an outer diameter of the device, whereby the outer diameter is varied by moving the press bars inwards and outwards.

3. The device of claim 2, wherein the tubular core has at least first external threads extending along at least part of the length of the core, and the adjustment mechanism comprises at least a first adjuster nut threadably engaged on the first external threads, and a plurality of first pivot links each having a first end pivoted to the first adjuster nut and a second end pivoted to a respective press bar, whereby rotation of the tubular core in opposite directions moves the adjuster nut in opposite first and second directions along the core, the pivot links being configured to move the press bars outward when the adjuster nut moves in the first direction and inward when the adjuster nut moves in the second direction.

4. The device of claim 3, wherein the locking device comprises a lock nut configured to jam the adjuster nut at a selected position on the tubular core, whereby the press bars are secured in a selected position relative to the tubular core to define a selected outer diameter of the device.

5. The device of claim 3, wherein the tubular core has first and second end portions, the first external threads being located on the first end portion, and the second end portion having second external threads, the first and second external threads being of the same angular threads per inch and of opposite hands, and the adjustment mechanism further comprises a second adjuster nut threadably engaged on the second external threads and a plurality of second pivot links each having a first end pivoted to the second adjuster nut and a second end pivoted to a respective press bar, whereby rotation of the tubular core in opposite directions moves the first and second adjuster nuts towards and away from one another along the tubular core, respectively and moves the press bars in opposite radial directions to adjust the outer diameter of the device.

6. The device of claim 3, wherein the pivot links are H-shaped.

7. The device of claim 3, wherein the adjuster nut has a generally rectangular outer periphery having four sides, each pivot link being pivoted to a respective side of the outer periphery of the adjuster nut.

8. The device of claim 3, wherein each press bar has opposite side edges having down turned rims facing toward the tubular core, and the respective pivot links are pivoted between the down turned rims of the respective press bars.

9. The device of claim 2, wherein each press bar has a curved outer surface.

10. The device of claim 9, wherein the curved outer surface of each press bar is of predetermined curvature which approximately matches the internal curvature of a center-pull doff in which the device is to be secured.

11. The device of claim 2, wherein the outer surface of each press bar is a roughened, high-friction surface.

12. The device of claim 1, wherein the core has a first threaded end portion on one side of the annular shoulder and a second threaded end portion on the opposite side of the annular shoulder, and the adjustment mechanism comprises first and second adjuster nuts threadably engaged with the first and second threaded end portions, respectively, and a pivotal linkage between the press bar portion and the adjuster nuts.

13. The device of claim 1, wherein the internal diameter of the tubular core is approximately three inches.

14. The device of claim 1, wherein the length of the press bar portion is at least approximately equal to the length of the tubular core.

15. A doff method of unwinding fiber from the outside of a virgin center-pull doff, comprising:

inserting a doff core device of fixed internal diameter and adjustable outer diameter into the hollow center of a center-pull doff;

expanding the outer diameter of the doff core device until an outer surface of the device presses against the inner surface of the center-pull doff, the doff core device including a tubular core with an outwardly projecting annular shoulder located between opposite ends of the core and an outer press bar portion having a plurality of elongate press bars extending parallel to a central longitudinal axis of the core and adjustably mounted on the tubular core for movement in radially inward and outward directions relative to the core, each press bar having a U-shaped cross section extending its entire longitudinal length and an inwardly facing slot, the outwardly projecting annular shoulder having a longitudinal length and the inwardly facing slot having a longitudinal length substantially the same as the longitudinal length of the annular shoulder so that during expanding the outer diameter of the doff core device the inwardly facing slot engages over the annular shoulder to guide the inward and outward movement of the respective press bar, whereby said press bars are at least substantially in parallel throughout the inward and outward movement;

locking the expanded doff core device in the expanded condition, whereby the center-pull doff is secured on the doff core device;

installing the core device and secured center pull doff on doff processing equipment configured to receive a core having said fixed internal diameter; and dispensing material from the doff from the outside to the inside of the doff.

16. The method of claim 15, further comprising removing the doff core device from the processing equipment after all material has been dispensed from the doff, unlocking the doff core device, contracting the outer diameter of the device to a predetermined reduced outer diameter, inserting the reduced diameter device into a second center-pull doff, and repeating the steps of expanding and locking the doff core device in the second center-pull doff before installing the core device and second center-pull doff onto the doff processing equipment and dispensing material from the doff from the outside to the inside of the doff.

17. The method of claim 15, wherein the step of expanding the outer diameter comprises rotating a central tubular core of the device in a first direction relative to at least one expander nut threadably engaged with a threaded outer surface portion of the tubular core, whereby the expander nut travels in a first direction along the tubular core and a plurality of pivot links between the nut and respective press bars rotate to move the respective press bars radially outwards until the outer surfaces of the press bars press against the inner surface of the center-pull doff.

18. The method of claim 17, further comprising removing the doff core device from the processing equipment after all material has been dispensed from the doff and contracting the outer diameter of the doff core device to a smaller outer diameter to allow it to be inserted into another center pull doff, the contracting step comprising rotating the central tubular core in a second, opposite direction relative to the expander nut, whereby the expander nut travels in a second, opposite direction along the tubular core and the pivot links rotate to move the press bars radially inwardly to reduce the outer diameter of the doff core device so that it can be inserted into a second center-pull doff.

* * * * *